US006792217B2

(12) United States Patent
Nishino et al.

(10) Patent No.: US 6,792,217 B2
(45) Date of Patent: Sep. 14, 2004

(54) USE STATUS DETECTING MECHANISM AND IMAGE-PRODUCING UNIT

(75) Inventors: Toshio Nishino, Yamatokoriyama (JP); Yasuyuki Ishiguro, Higashiosaka (JP); Takeshi Wakabayashi, Kyoto (JP); Toshihide Ohgoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/387,507

(22) Filed: Mar. 14, 2003

(65) Prior Publication Data

US 2003/0185579 A1 Oct. 2, 2003

(30) Foreign Application Priority Data

Mar. 15, 2002 (JP) ..... P2002-072292

(51) Int. Cl.[7] ..... G03G 15/00
(52) U.S. Cl. ..... 399/12; 399/111
(58) Field of Search ..... 399/12, 13, 24, 399/25, 26, 27, 113, 111

(56) References Cited

U.S. PATENT DOCUMENTS 6,298,202 B1 * 10/2001 Fushiya et al. ..... 399/12

FOREIGN PATENT DOCUMENTS

| | | |
|---|---|---|
| JP | 11-84987 A | 3/1999 |
| JP | 2000-47549 A | 2/2000 |
| JP | 2001-42585 A | 2/2001 |

* cited by examiner

*Primary Examiner*—Hoang Ngo
(74) *Attorney, Agent, or Firm*—Birch, Stewart, Kolasch, & Birch, LLP

(57) ABSTRACT

A use status detecting mechanism includes a cover having an edge portion, in a portion of which a notch is formed, a moving member having a rod member, a spring portion, protrusions and grooves, and a shaft having a driving gear and ribs. In the unused state of a developing unit, the rod member is maintained to be exposed by the contact of the protrusions with the edge portion from the outside. When the developing unit is started to be used and rotation is transmitted to the driving gear, the moving member is rotated by the engagement of the ribs and the grooves, and the moving member is moved to the shaft side by the elastic force of the spring portion when the protrusions are opposed to the notches. Thus, the rod member is retreated from the exposed position.

9 Claims, 6 Drawing Sheets

USE STATUS DETECTING MECHANISM AND IMAGE-PRODUCING UNIT

This nonprovisional application claims priority under 35 U.S.C. §119(a) on Patent Application No(s). 2002-072292 filed in JAPAN on Mar. 15, 2002, which is(are) herein incorporated by reference.

BACKGROUND OF THE INVENTION

1. Field of the Invention

The present invention relates to an image-producing unit that can be mounted removably in an image-forming apparatus that forms electrophotographic images such as a copier and a printer, and a use status detecting mechanism that is applied to the same.

2. Description of the Related Art

In some image-forming apparatuses that form electrophotographic images, a part or the entire of a drum-shaped or belt-shaped image support and other components arranged around the support such as a charging portion, a writing portion, a developing portion, a transferring portion and a cleaning portion are housed in a single housing so as to constitute an image-producing unit, and this image-producing unit is provided removably in an image-forming apparatus, which is a main apparatus. With this configuration, it is attempted to improve the maintenance properties.

However, in this image-producing unit, the components gradually deteriorate through use, and damages or the degradation of the image quality occur over time. Therefore, it is necessary to replace the image-producing unit by a new one before damages of the components or the degradation of the image quality occur.

For example, for the image support, the life is determined in view of the abrasion of the photosensitive layer on the surface. When the image support is used over the life, the image quality may be deteriorated by poor charging or a change in sensitivity, and the inside of the apparatus may be soiled by scattering of toner caused by abnormal discharge.

For this reason, conventionally, the timing at which the image-producing unit should be replaced was detected based on the number of recording media that were used to form images, or the number of revolution of the image support or the integrated value of the driving time or the like, and a message indicating that the unit should be replaced was generated so as to urge the user to replace the image-producing unit. When the user replaced the image-producing unit to a new one, the integrated value was cleared and addition was started anew.

However, in many types of the image-producing unit, the image-producing unit can be mounted on an image-forming apparatus, which is a main apparatus, regardless of whether the unit is in a used or unused state, and therefore when an image-producing unit that is in use is removed and an unused image-producing unit should be mounted, it is possible to erroneously mount a used image-producing unit. In particular, it is difficult to check out whether an image-producing unit to be mounted is in a used state or is in an unused state by visual observation, so that it is highly possible that the user erroneously mounts an image-producing unit that is in a used state.

Therefore, various structures are proposed to determine whether or not an image-producing unit to be mounted anew on an image-forming apparatus, which is a main apparatus, is in an unused state. Among these, a proposal to mark an image-producing unit to indicate that it is in a used state is suitable for a recycle process of the image-producing unit, because the unit can be returned to be in an unused state easily, but lacks in reliability regarding the determination whether the image-producing unit is in an unused state or in a used state.

In view of this point, a structure including an elliptical gear and a fixed hook is known, and Japanese Unexamined Patent Publication JP-A 2000-47549 (2000) discloses a structure in which detecting means included in an image-forming apparatus, which is a main apparatus, irreversibly deform or move a part of the image-producing unit. Japanese Unexamined Patent Publication. JP-A 11-84987 (1999) discloses a structure in which an engagement hole formed in the image-producing unit is closed when the unit is mounted on an image-forming apparatus, which is a main apparatus. These structures are intended to improve the reliability in the determination whether the image-producing unit is in an unused state or in a used state.

However, in the conventional structure that is intended to improve determination whether the image-producing unit is in an unused state or in a used state, it is necessary to add a large number of components to the image-producing unit, which disadvantageously makes a recycle process of the image-producing unit complicated and difficult and may increase the cost. These problems are generally caused not only in the image-producing unit in an image-forming apparatus, but also in an exchange unit that is configured to be removable with respect to a main apparatus.

SUMMARY OF THE INVENTION

An object of the invention is to provide a use status detecting mechanism that can improve the reliability in determination whether an exchange unit is in an unused state or in a used state without making a recycle process of the exchange unit complicated or difficult, by forming a mark indicating that the unit is in a used state in such a manner that the mark cannot easily be returned to the original state while reducing the number of components to be added to the exchange unit, and an image-producing unit to which the use status detecting mechanism is applied.

The invention includes the following features to solve the above-described problems.

The invention provides a use status detecting mechanism comprising:

- a moving member that is provided in an exchange unit that is provided removably in a main apparatus, can advance to and retreat from an exposed position in the exchange unit that can be visually observed from the outside, and can be detected by detecting means provided in the main apparatus; and
- a state-switching-member for retaining either a state where the moving member is exposed to the exposed position or a state where the moving member is retreated from the exposed position, depending on whether the exchange unit is in an unused state or in a used state.

According to the invention, the moving member that is provided so as to be capable of advancing to and retreating from an exposed position in the exchange unit that can be visually observed from the outside and is detected by detecting means provided in the main apparatus is retained to be in the state where the moving member is exposed to the exposed position or the state where the moving member is retreated from the exposed position, depending on whether the exchange unit is in an unused state or in a used state.

Therefore, as a result of visual observation whether the moving member is exposed to the exposed position or retreated from the exposed position, and as a result of detecting the moving member by the detecting means, it is determined accurately that the exchange unit is in the unused state or the used state. Furthermore, the moving member is displaced reversibly between the state where the moving member is exposed to the exposed position and the state where the moving member is retreated from the exposed position. Consequently, it is identified repeatedly with the same moving member whether the exchange unit is in an unused state or in a used state by displacing the moving member having been displaced from the state corresponding to the unused state of the exchange unit to the state corresponding to the used state to be in the state corresponding to the unused state at the time of a recycle process of the exchange unit.

Thus, the reliability in determination as to the unused state and the used state of an exchange unit can be improved without making a recycle process of the exchange unit complicated and difficult, by forming a mark indicating that the exchange unit is in a used state in such a manner that the mark cannot easily be returned to the original state, while reducing the number of components to be added to the exchange unit.

In the invention, it is preferable that the state-switching member switches the state with respect to the exposed position of the moving member by a driving force that is applied on the inside of the exchange unit from the main apparatus after the exchange unit is mounted on the main apparatus.

According to the invention, the state with respect to the exposed position of the moving member is changed by a driving force that is applied on the inside of the exchange unit mounted on the main apparatus from the main apparatus. Therefore, before the exchange unit is mounted on the main apparatus, during which the driving force is not applied on the inside of the exchange unit from the main apparatus, the moving member is not displaced from the state corresponding to the unused state of the exchange unit to the state corresponding to the used state. Furthermore, the moving member that has been displaced to the state corresponding to the used state is displaced from the state corresponding to the used state to the state corresponding to the unused state only by work with respect to the inside of the exchange unit in a recycle process or the like. Therefore, the moving member is not displaced to the state corresponding to the used state when an unused exchange unit is not used, and the moving member is not displaced to the state corresponding to the unused state when a used exchange unit is not subjected to a recycle process, so that it is determined accurately whether the exchange unit is in an unused state or a used state, based on the state of the moving member.

In the invention, it is preferable that the state-switching member includes:

- an elastic member for providing a force to move the moving member to a position corresponding to a used state;
- a regulating member for regulating the movement of the moving member to the position corresponding to the used state by being in contact with a protrusion projected from a portion of the moving member in a direction orthogonal to a direction in which the moving member advances and retreats in a portion around the axis parallel to the direction of the advancement and retreat; and
- a rotation transmitting member for rotating the moving member around the axis that is parallel to the direction of the advancement and retreat by a driving force that is applied from the main apparatus.

According to the invention, in the state where the driving force is not applied on the inside of the exchange unit from the main apparatus, the displacement of the moving member to the position corresponding to the used state by a force provided by the elastic member is regulated by the contact of the protrusion projected from a portion of the moving member with the regulating member. Therefore, in the unused exchange unit, the state corresponding to the unused state of the moving member is maintained. On the other hand, when the driving force is applied on the inside of the exchange unit from the main apparatus, the moving member is rotated by the rotation transmitting member, and the contact of the protrusion of the moving member with the regulating member is canceled and the moving member is displaced to the position corresponding to the used state by the force provided by the elastic member. Therefore, in the used exchange unit, the state corresponding to the used state of the moving member is maintained.

The invention provides an image-producing unit that is provided removably in an electrophotographic image-forming apparatus, the image-producing unit comprising:

- a moving member that can advance to and retreat from an exposed position in the image-producing unit that can be visually observed from the outside, and is detected by detecting means provided in the image-forming apparatus; and
- a use status detecting mechanism including a state-switching member for retaining a state where the moving member is exposed to the exposed position and a state where the moving member is retreated from the exposed position, depending on whether the unit is in an unused state or a used state.

In the invention it is preferable that the state-switching member switches the state with respect to the exposed position of the moving member by a driving force that is applied from the image-forming apparatus after the image-producing unit is mounted on the image-forming apparatus.

In the invention, it is preferable that the state-switching member includes:

- an elastic member for providing a force to move the moving member to a position corresponding to a used state;
- a regulating member for regulating the movement of the moving member to the position corresponding to the used state by being in contact with a protrusion projected from a portion of the moving member in the direction orthogonal to the direction in which the moving member advances and retreats in a portion around the axis parallel to the direction of the advancement and retreat; and
- a rotation transmitting member for rotating the moving member around the axis that is parallel to the direction of the advancement and retreat by a driving force that is applied from the image-forming apparatus.

According to the invention, the use status detecting mechanism described above is provided in the image-producing unit that is provided removably in an electrophotographic image-forming apparatus, which is the main apparatus. Therefore, as a result of visual observation whether the moving member is exposed to the exposed position or retreated from the exposed position, and as a result of detecting the moving member by the detecting means, it is determined accurately that the exchange unit is in the unused state or the used state. Furthermore, it is identified repeatedly with the same moving member whether the image-producing unit is in an unused state or a used state by displacing the moving member having been displaced from the state corresponding to the unused state of the image-producing unit to the state corresponding to the used state to be in the state corresponding to the unused state at the time of a recycle process of the image-producing unit.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
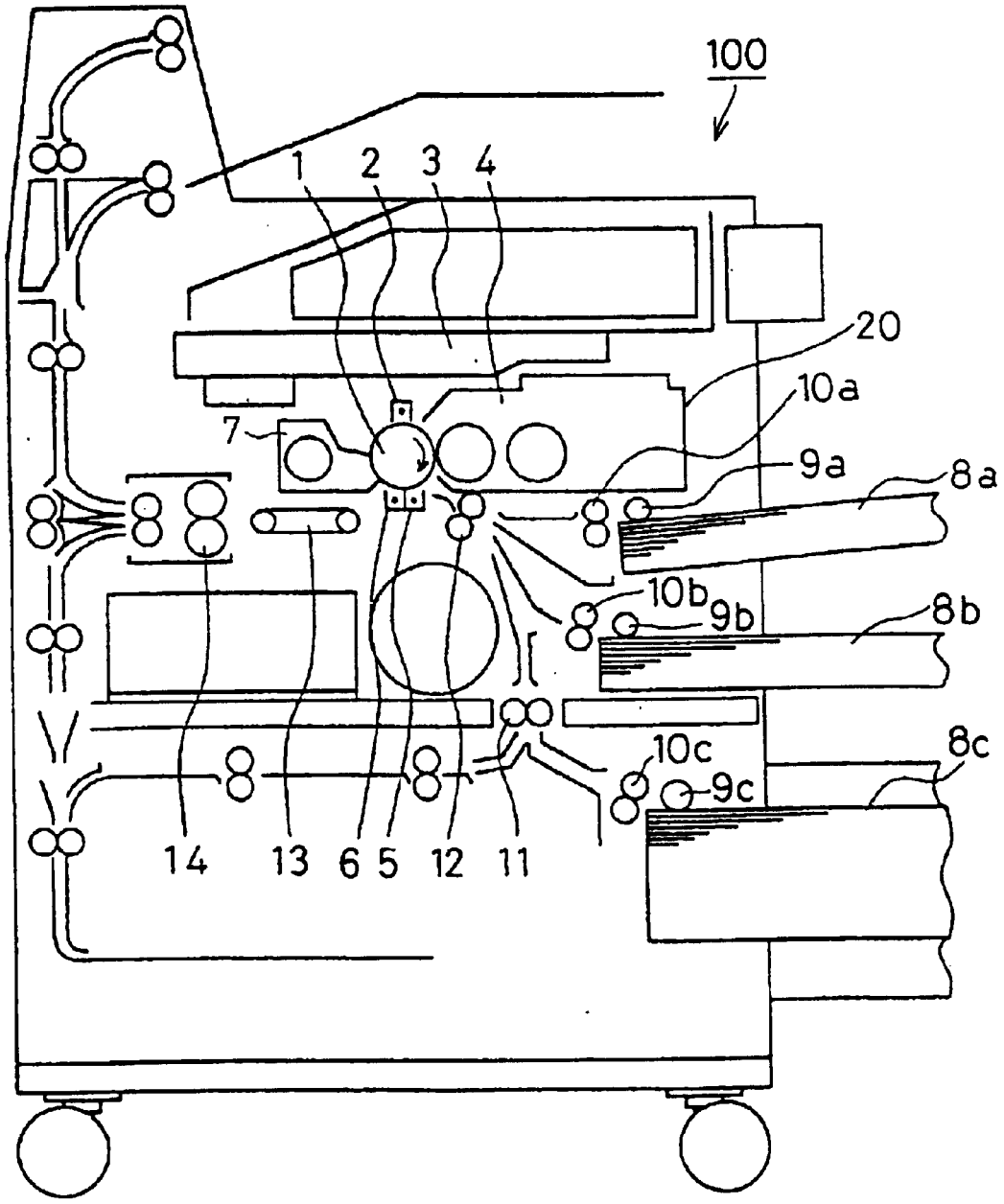
FIG. 1 is a view showing a general structure of an image-forming apparatus in which an image-producing unit, to which the use status detecting mechanism of an embodiment of the invention is applied, is mounted.

Now referring to the drawings, preferred embodiments of the invention are described below.

FIG. 1 is a view showing a general structure of an image-forming apparatus in which an image-producing unit, to which a use status detecting mechanism of an embodiment of the invention is applied, is mounted. An image-forming apparatus 100, which is the main apparatus of the invention, includes a photosensitive drum 1 that can rotate in the direction shown by an arrow, which is an image support, approximately in the center in the inside thereof. Around the photosensitive drum 1, a charger 2, a writing unit 3, a developing unit 4, a transferring device 5, and a separating device and a cleaner 7 are arranged in this order along the direction of the rotation of the photosensitive drum 1.

A photosensitive layer having a photoconductivity is formed on the photosensitive drum 1, and the charger 2 uniformly charges the surface of the photosensitive drum 1 with a predetermined amount of charges. The writing unit 3 irradiates the photosensitive drum 1 with image light such as laser light that is modulated in accordance with image data, so as to remove the charges selectively, so that an electrostatic latent image is formed on the surface of the photosensitive drum 1. The developing unit 4, which is an exchange unit of the invention, supplies a developer onto the surface of the photosensitive drum 1 to convert the electrostatic latent images into visible developed images. The transferring device 5 transfers the developed images supported on the surface of the photosensitive drum 1 onto a sheet of paper. The separating device 6 peels the sheet on which the developed images are transferred from the surface of the photosensitive drum 1. The cleaner 7 removes the remaining developer, paper powder and the like from the surface of the photosensitive drum 1 from which the developed images have been transferred.

Paper feeding cassettes 8*a* to 8*c* are mounted on one side of the image-forming apparatus 100. Each of the paper feeding cassettes 8*a* to 8*c* contain a plurality of sheets having a single size. Pick-up rollers 9*a* to 9*c* are provided in a position opposing the uppermost surface of the sheets contained in the corresponding paper feeding cassettes 8*a* to 8*c*, respectively. Paper feeding rollers 10*a* to 10*c*, a conveying roller 11 and a resist roller 12 are arranged in the path for conveying paper sheets from the paper feeding cassettes 8*a* to 8*c* to the position between the photosensitive drum 1 and the transferring device 5.

The pick-up rollers 9*a* to 9*c* pick up a paper sheet positioned uppermost contained in the paper feeding cassettes 8*a* to 8*c*. The paper feeding rollers 10*a* to 10*c* guide the picked-up paper sheet one after another to the path for conveying paper sheets. The conveying roller 11 continues the conveyance of the paper sheet along the path for conveying paper sheets. The resist roller 12 guides the conveyed sheet to a position between the photosensitive drum 1 and transferring device 5 at a timing in synchronization with the rotation of the photosensitive drum 1. Thus, a developed image can be transferred in an appropriate position on the paper sheet. The sheet on which the developed image has been transferred is guided to a fixing apparatus 14 by a conveying belt 13. The developed image is heated and pressed in the fixing apparatus 14 and thus thermally fixed on the paper sheet.

Figure 2:
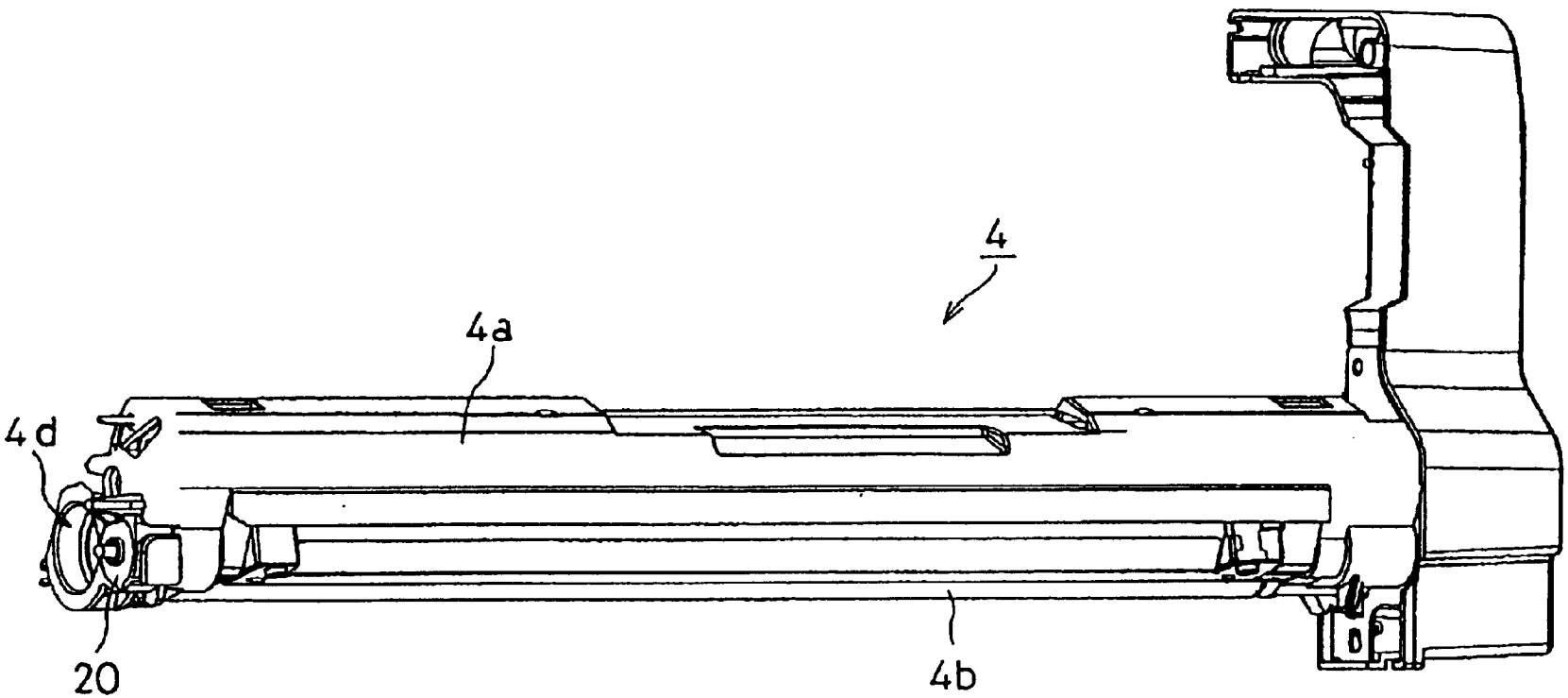
FIG. 2 is a view externally viewed from the top of a developing unit, which is an image-producing unit to which the use status detecting mechanism of an embodiment of the invention is applied.

FIG. 2 is an appearance view from the top of a developing unit, which is an image-producing unit to which a use status detecting mechanism of an embodiment of the invention is applied. In the developing unit 4, a developing roller 4*b* is axially supported together with a sponge roller and a stirring roller in a casing 4*a* that is a hollow container in which a developer bath for storing a developer is formed, and a doctor blade for regulating the thickness of a layer of a developer on the circumferential surface of the developing roller 4*b* is fixedly provided therein. In addition, the developing roller 4*b* is provided with a driving gear for transmitting rotational power from an external driving motor. The sponge roller supplies a developer contained in a hopper mounted on the upper surface of the developing unit 4 above the developing bath to the inside of the developing bath. The stirring roller conveys the developer in the developing bath into the developing roller 4*b* while stirring the developer. A part of the circumferential surface of the developing roller 4*b* is projected from the casing 4*a* and exposed toward the photosensitive drum photosensitive drum 1, and supplies the developer to the photosensitive drum 1 such a manner that the developer is attached on the circumferential surface thereof in the form of a layer with a thickness regulated by the doctor blade.

Figure 3:
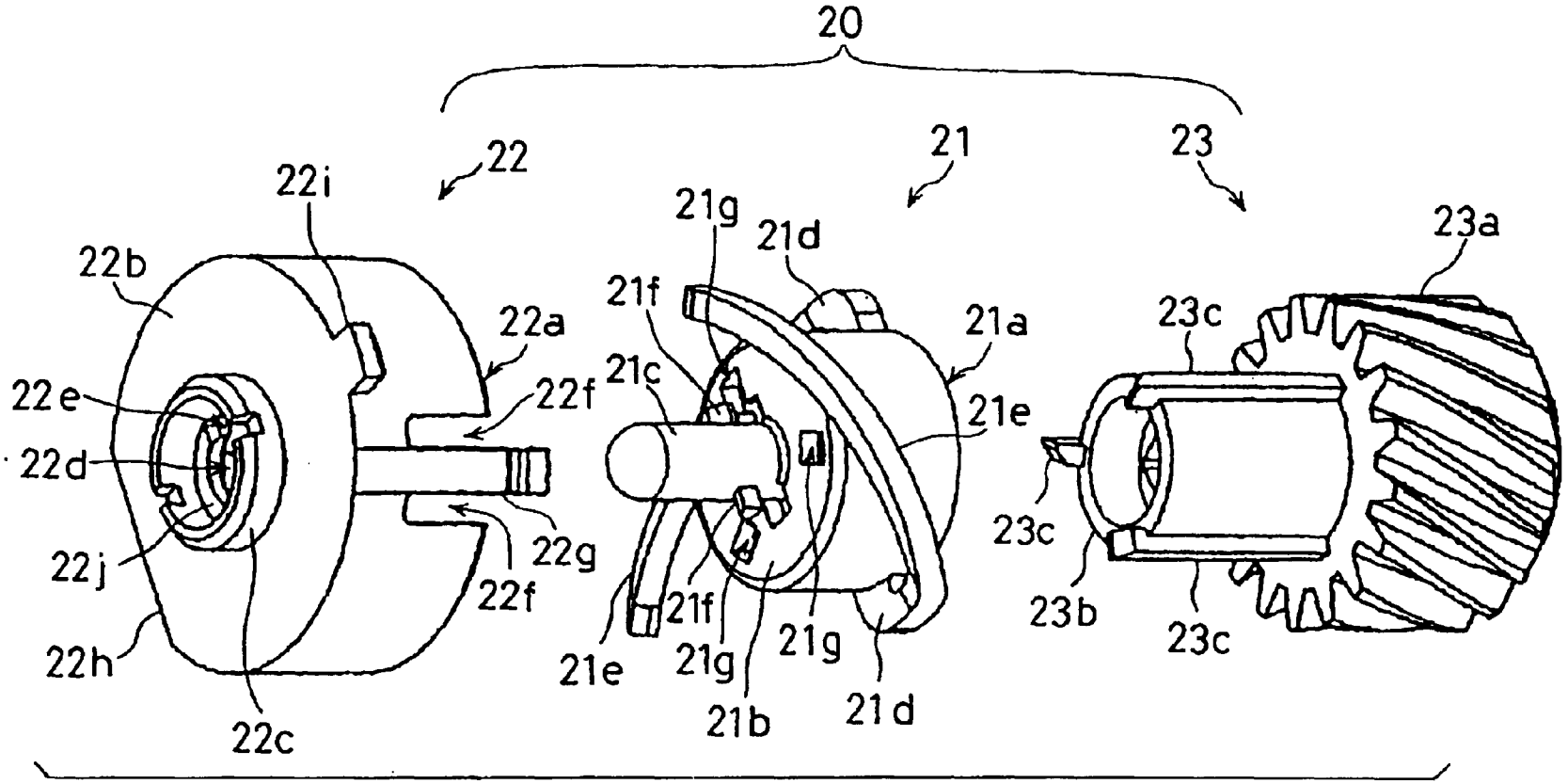
FIG. 3 is a perspective exploded view showing the structure of the use status detecting mechanism of an embodiment of the invention.
Figure 4:
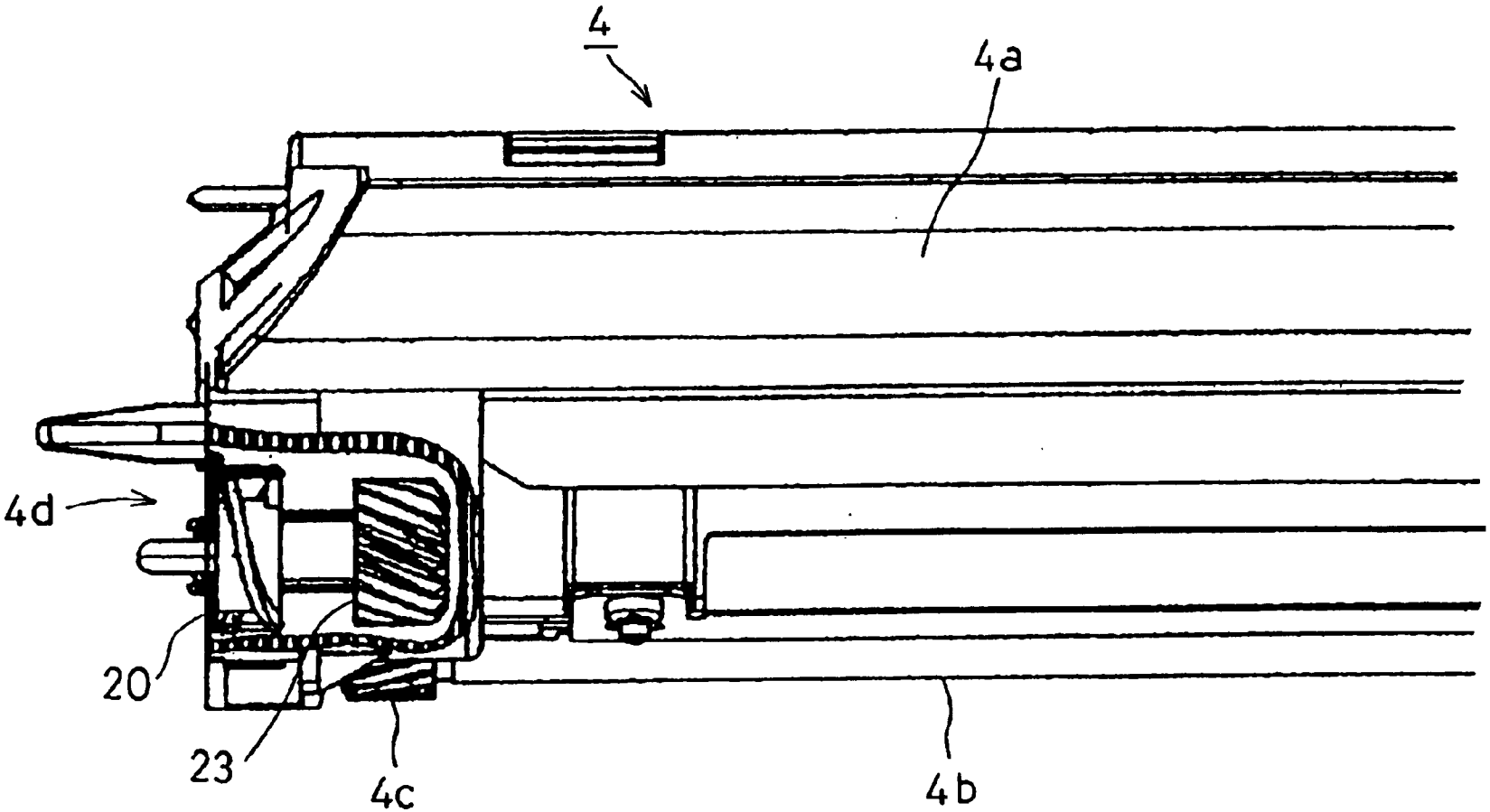
FIG. 4 is a cross-sectional partial view showing the state where the use status detecting mechanism is attached to the developing unit.

FIG. 3 is a perspective exploded view showing the structure of the use status detecting mechanism of an embodiment of the invention. FIG. 4 is a cross-sectional partial view showing the state where the use status detecting mechanism is attached to the developing unit. A use status detecting mechanism 20 of this embodiment includes a moving member 21, a cover 22 and a shaft 23, all of which are molded with resin.

The moving member 21 is open in one side 21*a* and has a hollow cylindrical shape in which a rod member 21*c* is projected from the central portion of the other side 21*b* in the direction opposite to the side 21*a* in the axial direction of the moving member 21. A supporting portion 21*d* is projected outward in the radial direction of the moving member 21 from two portions 180 degrees apart in the circumferential direction on the end portion on the side 21*a* side on the circumferential surface of the moving member 21. A spring portion 21*e*, one end of which is continuous to the supporting portion 21*d*, extends in the form of an arc towards the side 21*b*. The spring portion 21*e* is an elastic member of the invention and deforms elastically in the state where the other-end, which is an open end, can be displaced toward the side 21*a* along the axial direction of the moving member 21. A protrusion 21*f* is projected outward in the radial direction from two portions 180 degree apart in the circumferential direction on the circumferential surface of the rod member 21*c*. A hole 21*g* is formed in three portions 120 degree apart in the circumferential direction on the side 21*b* of the moving member 21. Each of the holes 21*g* is continuous to a groove 21*h* (see FIG. 5B) in the axial direction that is formed on the inner circumferential surface of the moving member 21. This groove 21*h* is formed throughout the length in the axial direction of the circumferential surface of the moving member 21 and is open to the side 21*a*.

The cover 22 is open on one side 22*a*, and has a hollow cylindrical shape in which a boss 22*c* is projected from the central portion of the other side 22*b* in the direction opposite to the side 22*a* in the axial direction of the cover 22. The inner diameter of the cover 22 is approximately equal to the outer diameter of the moving member 21 including the supporting portion 21*d* and the spring portion 21*e*, and the moving member 21 is inserted in the internal portion of the cover 22. A hole 22*d* in which a rod 21*c* of the moving member 21 is inserted is formed in the central portion of the side 22*b*. Notches 22*e* that can be penetrated by the protrusion 21*f* of the moving member 21 are formed in positions 180 degrees apart in the circumferential direction in an edge portion 22*j* of the hole 22*d*. This edge portion 22*j* corresponds to the regulating member of the invention. Furthermore, a hook 22*g* interposed between two spaces 22*f* is formed in a portion of the circumferential surface of the cover 22. Another portion on the circumferential surface of the cover 22 is linearly cut so as to form a planar portion 22*h*. In addition, a protrusion 22*i*, which is projected outward in the radial direction, is formed on the end on the side 22*b* side on the circumferential surface of the cover 22.

The shaft 23 includes a driving gear 23*a* made of a skew bevel gear and a cylindrical sleeve 23*b* that is projected in the axial direction from the center of one side of the driving gear 23*a*. As shown in FIGS. 2 and 4, the use status detecting mechanism 20 is attached inside the developing unit 4 in such a manner that the driving gear 23*a* is engaged in the driving gear 4*c* made of a skew bevel gear of the developing roller 4*b* included in the developing unit 4. The outer diameter of the sleeve 23*b* is smaller than at least the inner diameter of the moving member. 21, so that a part of the sleeve 23*b* on the side opposite to the driving hear 23*a* is housed in the internal portion of the moving member 21. A rib 23*c*, which is projected outward in the radial direction of the sleeve 23*b*, is formed in three portions 120 degrees apart in the circumferential direction on the circumferential surface of the sleeve 23*b*. Each of the ribs 23*c* is engaged in the groove 21*h* and the hole 21*g* of the moving member 21 when a part of the sleeve 23*b* is housed in the internal portion of the moving member 21. The end of each of the ribs 23*c* on the side opposite to the driving gear 23*a* is projected from the end of the sleeve 23*b* on the side opposite to the driving gear 23*a*.

The use status detecting mechanism 20 is inserted in the developing unit 4 in the axial direction from the open portion 4*d* on the side of the back face of the casing 4*a* thereof toward the internal portion and is attached in a predetermined position. In this case, the rotation position of the use status mechanism 20 with respect to the developing unit 4 can be determined by opposing the planar portion 22*h* and the protrusion 22*i* of the cover 22 to a planar portion and a recess (not shown) of the casing 4*a*. When the use status mechanism 20 is inserted into a predetermined position inside the casing 4*a*, the hook 22*g* of the cover 22 is engaged in a step portion (not shown) formed in the casing 4*a*, and thus the position in the axial direction of the use status detecting mechanism 20 with respect to the casing 4*a* is determined. This engagement state of the hook 22*g* with respect to the step portion can be cancelled manually by an operator or with a tool, and the use status detecting mechanism 20 can be removed from the casing 4*a* by canceling the engagement state of the hook 22*g* with respect to the step portion.

In the above-described structure, the spring portion 21*e* and the groove 21*h* of the moving member 21, the edge portion 22*j* of the cover 22 and the ribs 23*c* of the shaft 23 constitute a state-switching member of the invention. Among these, the grooves 21*h* of the moving member 21 and the ribs 23*c* the shaft 23 constitute a rotation transmitting member of the invention.

Figure 5B:
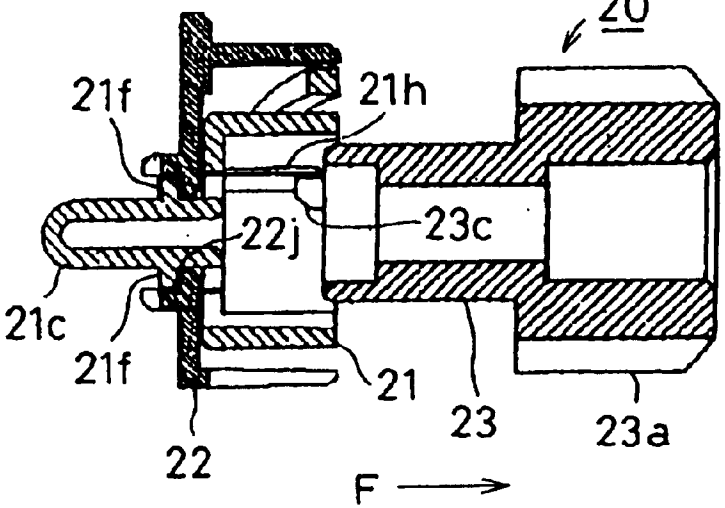
FIGS. 5A and 5B are views illustrating a method for displaying that the developing unit is in an unused state by the use status detecting mechanism.
Figure 5A:
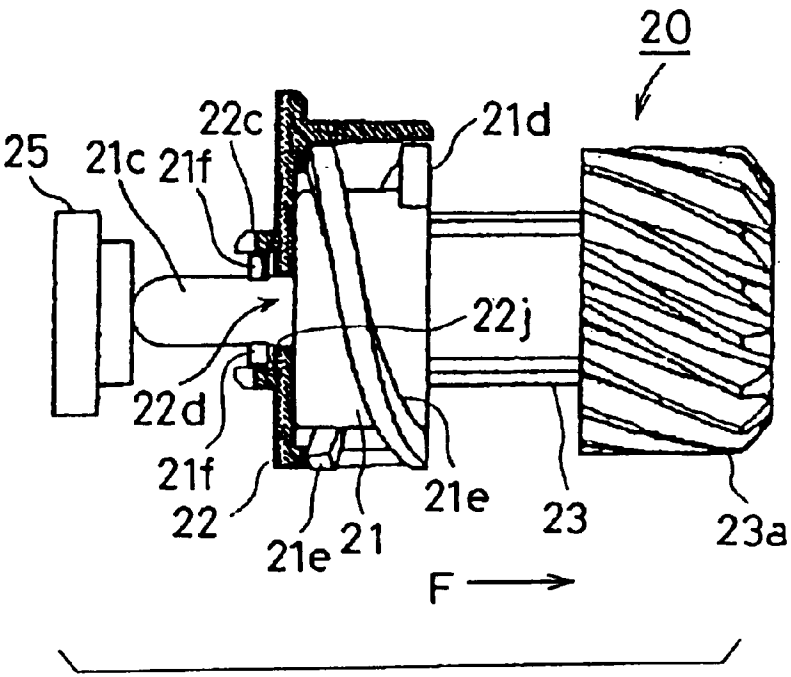

FIGS. 5A and 5B and 6A and 6B are view illustrating a method for displaying the unused state and the used state of the developing unit by the use status detecting mechanism. In an unused developing unit 4, the entire use status detecting mechanism 20 except the rod member 21*c* is housed inside the cover 22, as shown in FIGS. 5A and 5B. In this case, the rod member 21*c* of the moving member 21 penetrates the hole 22*d* of the cover 22 from the inside of the cover 22 and exposed to the outside of the boss 22*c* and thus is located in an exposed position. The spring portion 21*e* of the moving member 21 is compressed by a contact of its open end, that is, a free end, and the internal surface of the cover 22, and is elastically deformed while being compressed from the side of the supporting portion 21*d* toward the side 22*b* of the cover 22 with respect to the axial direction of the moving member 21.

In this state, the restoring force of the spring portion 21*e* that is elastically deformed acts in the direction shown in an arrow F in the moving member 21, and a force is imposed on the moving member 21 in such a direction to move the moving member 21 apart from the cover 22. However, the protrusion 21*f* that is projected from the circumferential surface of the rod member 21*c* of the moving member 21 is in contact with the edge portion 22*j* between the hole 22*d* and the boss 22*c* of the cover 22 from the outside of the cover 22, and thus the entire use status detecting mechanism 20 except the rod member 21*c* of the moving member 21 is maintained to be housed inside the cover 22, as shown in FIGS. 5A and 5B.

To house the moving member 21 inside the cover 22, first, the relative position of the moving member 21 and the cover 22 in a plane orthogonal to the rotation axis is determined such that the rod member 21*c* of the moving member 21 is opposed to the hole 22*d* of the cover 22, and the rotation position of the moving member 21 and the cover 22 is determined such that the protrusion 21*f* of the moving member 21 is opposed to the notch 22*e* of the cover 22. With this state, the moving member 21 is inserted into the cover 22 against the elastic force of the spring portion 21*e*. When the rod member 21*c* of the moving member 21 penetrates the hole 22*d* of the cover 22 and the protrusion 21*f* is exposed to the outside of the edge portion 22*j* of the cover 22, then the moving member 21 is rotated at a rotation angle other than 180 degrees with respect to the cover 22, so that the protrusion 21*f* is contacted with the edge portion 22*j* from the outside of the cover 22. In this state, the movement of the moving member 21 to the direction shown in the arrow F with respect to the cover 22 is regulated because of the contact of the protrusion 21*f* with the edge portion 22*j*, but the rotation with respect to the cover 22 is not inhibited.

The entire use status detecting mechanism 20 except the rod member 21*c* of the moving member 21 is housed inside the cover 22, and the rod member 21*c* is exposed to the outside of the boss 22*c* of the cover 22, as shown in FIGS. 5A and 5B. With this state, the use status detecting mechanism 20 is mounted on an unused developing unit 4. Therefore, in the unused developing unit 4, it is visually observed from the back face of the casing 4*a* that the rod member 21*c* is exposed from the boss 22*c* of the cover 22.

As described above, when a part of the sleeve 23*b* of the shaft 23 is inserted in the moving member 21, the ribs 23*c* formed on the circumferential surface of the sleeve 23*b* are engaged in the grooves 21*h* formed in the inner circumferential surface of the moving member 21. Therefore, the rotation of the moving member 21 and the shaft 23 is inhibited with respect to the circumferential direction, but the moving member 21 and the shaft 23 can be moved with respect to the axial direction.

When the unused developing unit 4 in which the rod member 21*c* is exposed to the outside of the boss 22*c*, as shown in FIGS. 5A and 5B, is mounted in a predetermined position of the image-forming apparatus 100, then the tip of the rod member 21*c* is contacted with a sensor 25 attached to the image-forming apparatus 100, as shown in FIG. 5A, and the sensor 25 is turned on, so that the image-forming apparatus 100 detects that an unused developing unit 4 is mounted. The sensor 25 is detecting means of the invention.

Figure 6B:
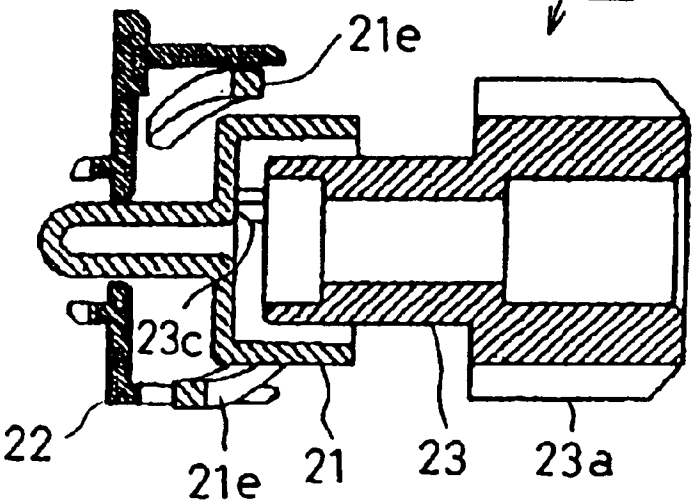
FIGS. 6A and 6B are views illustrating a method for displaying that the developing unit is in a used state by the use status detecting mechanism.
Figure 6A:
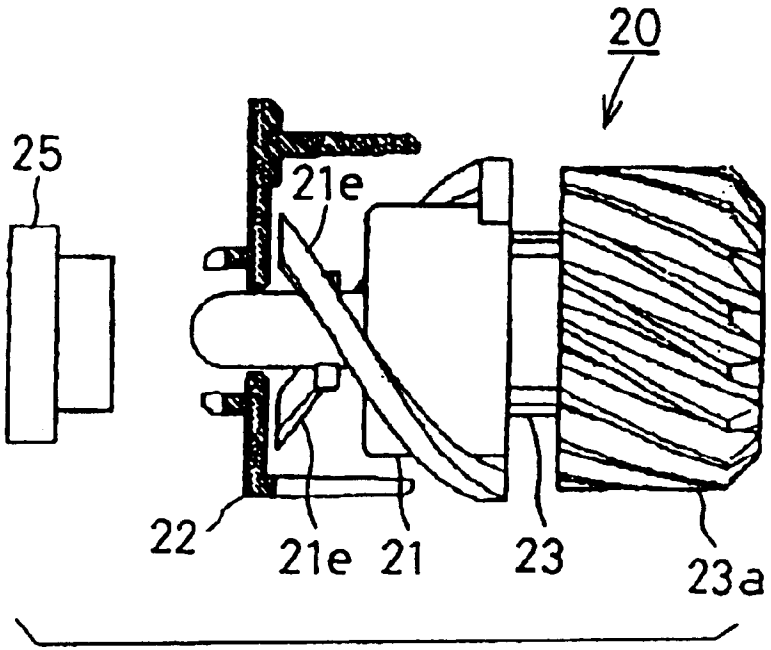

In this state, the image-forming apparatus 100 starts to operate. When the rotatory power of a driving motor provided in the image-forming apparatus 100 is transmitted to the driving gear 4*c* in the developing unit 4, the shaft 23 is rotated in cooperation with the driving gear 4*c* via the driving gear 23*a* engaged in the driving gear 4*c*. The rotation of the shaft 23 is transmitted to the moving member 21 whose rotation operation in the circumferential direction is inhibited as well as the shaft 23, and the moving member 21 is rotated together with the shaft 23 with respect to the cover 22 whose movement in the axial direction with respect to the casing 4*a* of the developing unit 4 and the rotation in the circumferential direction are regulated. When the protrusion 21*f* of the moving member 21 is rotated by this rotation up to the position opposing the notch 22*e* in the edge portion 22*j* of the cover 22, then the protrusion 21*f* is not in contact with the edge portion 22*j* any more, which eliminates regulation of the movement to the direction shown by the arrow F of the moving member 21 that is provided with a force by the elastic force (restoring force) of the spring portion 21*e*. Thus, as shown in FIGS. 6A and 6B, the moving member 21 that has been housed in the cover 22 is moved to the direction close to the driving gear 23*a* by the sliding of the ribs 23*c* with respect to the grooves 21*h*. Thus, a portion of the moving member 21 is exposed from the cover 22, and the rod member 21*c* of the moving member 21 is not exposed to the outside of the boss 22*c*.

This state where the rod member 21*c* is not exposed to the outside of the boss portion 22*c* is maintained in the developing unit 4 with the used state by the contact of the open end of the spring portion 21*e* of the moving member 21 and the inner surface of the cover 22. Therefore, in the used developing unit 4, it is visually observed from the back face of the casing 4*a* that the rod member 21*c* is not exposed to the outside of the boss 22*c* of the cover 22.

As shown in FIGS. 6A and 6B, when the used developing unit 4 in which the major part of the rod member 21*c* is retreated to the inside of the boss 22*c* is mounted in a predetermined position of the image-forming apparatus 100, the sensor 25 attached to the image-forming apparatus 100 is not contacted with the tip of the rod member 21*c*, as shown in FIG. 6A, and the sensor 25 is turned off. Thus, the image-forming apparatus 100 detects that an used developing unit 4 is mounted.

In this manner as described above, in the use status detecting mechanism 20 of this embodiment, whether the developing unit 4 is in an unused state or a used state can be identified accurately based on whether or not the rod member 21*c* is exposed to the outside of the boss 22*c* of the cover 22 on the back face of the casing 4*a*. Moreover, the movement of the moving member 21 by the elastic force of the spring portion 21*e* is regulated by the contact of the protrusion 21*f* of the moving member 21 with the edge portion 22*j* of the cover 22, and this regulation is canceled by the rotation of the moving member 21 in cooperation with the rotation of the driving gear 23*a* engaged in the driving gear 4*c*. Thus, the state where the rod member 21*c* is exposed to the outside of the boss 22*c* of the cover 22, or the state where the rod member 21*c* is not exposed thereto are maintained reliably, so that the unused state and the used state of the developing unit 4 can be identified accurately with a simple structure.

In the above embodiment, in the unused state of the developing unit 4, the rod member 21*c* is exposed to an exposed position so that the rod member 21*c* is detected by the sensor 25, whereas in the used state of the developing unit 4, the rod member 21*c* is retreated from the exposed position so that the rod member 21*c* is not detected by the sensor 25. However, the invention can be configured the other way around as follows. In the used state of the developing unit 4, the rod member 21*c* is exposed to an exposed position so that the rod member 21*c* is detected by the sensor 25, whereas in the unused state of the developing unit 4, the rod member 21*c* is retreated from the exposed position so that the rod member 21*c* is not detected by the sensor 25. Moreover, the sensor 25 may be turned on when the rod member 21*c* is retreated from the exposed position, and the sensor 25 may be turned off when the rod member 21*c* is exposed to the exposed position.

When subjecting the used developing unit 4 to a recycle process to reuse the developing unit as an unused developing unit 4, after the use status detecting mechanism 20 is removed from the casing 4*a*, the following operations can be performed in this order: The relative position of the moving member 21 and the cover 22 with respect to the plane orthogonal to the rotation axis is determined by opposing the rod member 21*c* of the moving member 21 to the hole 22*d* of the cover 22; the rotation position of the moving member 21 and the cover 22 is determined by opposing the protrusion 21*f* of the moving member 21 to the notch 22*e* of the cover 22; the moving member 21 is inserted into the cover 22 against the elastic force of the spring portion 21*e*; and the moving member 21 is rotated at a rotation angle other than 180 degrees with respect to the cover 22, so that the protrusion 21*f* is contacted with the edge portion 22*j* from the outside of the cover 22. Thus, the use status detecting mechanism 20 can be turned to be in an unused state. Consequently, a simple operation at the time of regenerating the developing unit 4 allows the use status detecting mechanism 20 to be used repeatedly, and thus the cost performance can be improved.

The above embodiment has been described by taking an example in which the use status detecting mechanism of the invention is applied to the developing unit 4 that is provided removably in the image-forming apparatus 100. However, the invention is not limited to this embodiment, and can be applied to other exchange units, as long as the exchange unit can provide the use status detecting mechanism with a rotatory power when the exchange unit is mounted onto the main apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A use status detecting mechanism comprising:

a moving member that is provided in an exchange unit that is provided removably in a main apparatus, the moving member can advance to and retreat from an exposed position in the exchange unit so that it can be visually observed from the outside, and can be detected by detecting means provided in the main apparatus; and a state-switching member for retaining either a state where the moving member is exposed to the exposed position or a state where the moving member is retreated from the exposed position, depending on whether the exchange unit is in an unused state or in a used state.

2. The use status detecting mechanism of claim 1, wherein the state-switching member switches the state with respect to the exposed position of the moving member by a driving force that is applied on the inside of the exchange unit from the main apparatus after the exchange unit is mounted on the main apparatus.

3. The use status detecting mechanism of claim 2, wherein the state-switching member includes:

an elastic member for providing a force to move the moving member to a position corresponding to a used state;

a regulating member for regulating the movement of the moving member to the position corresponding to the used state by being in contact with a protrusion projected from a portion of the moving member in a direction orthogonal to a direction in which the moving member advances and retreats in a portion around the axis parallel to the direction of the advancement and retreat; and a rotation transmitting member for rotating the moving member around the axis that is parallel to the direction of the advancement and retreat by a driving force that is applied from the main apparatus.

4. An image-producing unit that is provided removably in an electrophotographic image-forming apparatus, the image-producing unit comprising:

a moving member that can advance to and retreat from an exposed position in the image-producing unit that can be visually observed from the outside, and is detected by detecting means provided in the image-forming apparatus; and a use status detecting mechanism including a state-switching member for retaining a state where the moving member is exposed to the exposed position and a state where the moving member is retreated from the exposed position, depending on whether the unit is in an unused state or a used state.

5. The image-producing unit of claim 4, wherein the state-switching member switches the state with respect to the exposed position of the moving member by a driving force that is applied from the image-forming apparatus after the image-producing unit is mounted on the image-forming apparatus.

6. The image-producing unit of claim 5, wherein the state-switching member includes:

an elastic member for providing a force to move the moving member to a position corresponding to a used state;

a regulating member for regulating the movement of the moving member to the position corresponding to the used state by being in contact with a protrusion projected from a portion of the moving member in a direction orthogonal to a direction in which the moving member advances and retreats in a portion around the axis parallel to the direction of the advancement and retreat; and a rotation transmitting member for rotating the moving member around the axis that is parallel to the direction of the advancement and retreat by a driving force that is applied from the image-forming apparatus.

7. A use status detecting mechanism comprising:

a moving member that is provided in an exchange unit that is provided removably in a main apparatus, the moving member can advance to and retreat from an exposed position in the exchange unit that can be visually observed from the outside, and detecting means provided in the main apparatus for detecting the moving member; and a state-switching member for retaining either a state where the moving member is exposed to the exposed position or a state where the moving member is retreated from the exposed position, depending on whether the exchange unit is in an unused state or in a used state.

8. The use status detecting mechanism of claim 7, wherein the detecting means is a physical touch sensor.

9. The use status detecting mechanism of claim 7, wherein the detecting means has means for physically contacting a tip of the moving member.

* * * * *